United States Patent [19]

Reinhardt et al.

[11] 4,080,480

[45] Mar. 21, 1978

[54] CATALYZING CELLULOSIC TEXTILE FINISHING PROCESSES WITH PHOSPHONIC ACID DERIVATIVES

[75] Inventors: Robert M. Reinhardt, New Orleans; Russell M. H. Kullman, Metairie; Donald J. Daigle, New Orleans, all of La.

[73] Assignee: The United States of America as represented by the Secretary of Agriculture, Washington, D.C.

[21] Appl. No.: 694,260

[22] Filed: Jun. 9, 1976

[51] Int. Cl.[2] ..... B05D 3/02

[52] U.S. Cl. ..... 427/390 C; 8/116 P; 8/184; 427/381; 427/382; 427/390 D

[58] Field of Search ..... 427/390 C, 381, 382; 8/116 P, 184

[56] References Cited

U.S. PATENT DOCUMENTS

| | | | |
|---|---|---|---|
| 2,953,481 | 9/1960 | Wedell | 427/390 C |
| 3,219,407 | 11/1965 | Sommer et al. | 427/390 C |
| 3,617,195 | 11/1971 | Moyse et al. | 427/390 C |
| 3,963,437 | 6/1976 | LeBlanc et al. | 8/116 P |
| 4,018,950 | 4/1977 | Reinhardt et al. | 427/390 C |

*Primary Examiner*—Harry J. Gwinnell
*Attorney, Agent, or Firm*—M. Howard Silverstein; David G. McConnell; Salvador J. Cangemi

[57] ABSTRACT

Alkyl and aryl phosphonic acids and certain salts thereof have been found useful as catalysts for the chemical reactions involved in finishing cotton and other cellulosic textiles. These versatile catalysts can be employed in a variety of finishing treatments including dimensional stability, durable press, and flame resistance and are operative under a diverse range of processing conditions.

5 Claims, No Drawings

CATALYZING CELLULOSIC TEXTILE FINISHING PROCESSES WITH PHOSPHONIC ACID DERIVATIVES

BACKGROUND OF THE INVENTION (1) Field of the Invention

This invention relates to finishing processes for textiles, and more particularly to the use of phosphonic acid derivatives as catalysts in the treatment of cellulose-containing materials with agents to give dimensional stability, durable press, and flame resistant textile products.

It is well known that dimensional stability, durable press, and flame resistance of cellulose-containing textiles can be enhanced by suitable treatment of such materials with certain chemical agents. The chemical agents employed in such treatments generally require catalysts to affect reaction with the cellulosic component to achieve improvement of the desirable properties in the finished products. Considerations of cost, efficiency, compatibility, toxicity, pollution effects, and many other factors have limited the scope of catalysts acceptable in finishing operations. Those catalysts widely employed in the processing of textiles for durable press, for instance, are not normally useful in other processes.

(2) Description of the Prior art

In the prior art we find reference to at least three finishing processes reportedly useful in producing products with improved dimensional stability, durable press performance, and flame resistance. These processes are mild cure, damp or moist cure, and pad-dry-cure finishing procedures. The latter process, and with modifications thereof, has been the most widely practiced commercially.

Mild cure and damp cure processes were developed as rather special techniques particularly to achieve high wet wrinkle resistance. These processes require catalysts that normally are not acceptable for use in other processes. In general, catalysts for these two processes were prepared by moderating mineral acids, as acids alone required very precise control of treatment conditions to avoid overcuring and severe strength loss.

Mild cure finishing is accomplished by padding fabric with a chemical agent to react with cellulose and strong catalyst, then heating the wet, impregnated fabric at about 60°–100° C for a short time without a pre-drying step. Detailed description of this process is given in the Textile Chemist and Colorist, Volume 1, page 415, 1969, and Volume 2, page 337, 1970.

Damp or moist cure finishing is similar to mild cure finishing in that a chemical agent and a strong catalyst are applied to fabric but then moisture content is carefully reduced to the range of 6–12%, after which fabric is sealed in a package to prevent moisture loss and held at room temperature for 12–24 hours, then neutralized and washed. More specific description of this process is given in U.S. Pat. No. 3,409,462.

Pad-dry-cure finishing follows the sequence of impregnating fabric with a chemical agent and catalyst, drying at a moderately elevated temperature, generally not exceeding about 100° C, then curing at temperatures of 150° to about 180° C.

In the widely used pad-dry-cure process, Lewis acid type catalysts have been dominant in durable press finishing. Two salts, zinc nitrate and magnesium chloride, have been the principal catalysts used by industry.

A serious problem exists in the textile industry with the two catalysts most widely used in wrinkle resistant finishing, zinc nitrate and magnesium chloride. Several geographical areas have either banned or heavily restricted the use of zinc nitrate or any heavy-metal salt because plant effluents cause stream pollution. Also, many finishers have found that nitrate catalysts can cause shade changes with certain dyestuffs or yellowing on some white goods. Many textile plants can no longer use magnesium chloride or any halide-containing catalyst for fear of generation of bis(chloromethyl) ether which has been designated as carcinogenic. In addition, fuel and chemical shortages are causing finishers to seek catalysts that allow processing to be conducted with lower curing temperatues and faster curing times in an effort to conserve energy.

Traditionally, chemical finishing treatments to produce flame resistance also have been carried out by the pad-dry-cure process. Catalyst systems usually consist of some type of Lewis acid or combination of a Lewis acid and an organic acid but there are no outstanding catalysts that dominate this field. Sanderson et al, Textile Research Journal 40, pages 217–222 (1970) have employed lower dialkyl and trialkyl phosphites as phosphonate precursors to become a substantial part of the ultimate flame resistant product but these phosphites are reactive agents and not catalysts. Wedell, U.S. Pat. No. 2,953,481, teaches the use as catalysts of high-molecular phosphonic acid salts that are derived from low-molecular aliphatic amines, diamines, oxyalkylamines, etc. which are volatile or readily react with formaldehyde. However, only phosphonic acids of at least 8 carbon atoms are operative in the Wedell disclosure. Sommer et al, U.S. Pat. No. 3,219,407, describe the use of copolymers of vinyl phosphonic acid of 50–100 molecular units as catalysts in creaseproofing cellulose textiles and claim improved strength in the finished product. Monomeric, saturated phosphonic acids were not so employed.

While the treatments and processes described above impart highly desirable properties to cellulose-containing textiles, there are a multitude of catalysts required, and no one specific class is satisfactory in all cases.

SUMMARY OF THE INVENTION

It is an object of this invention to provide an improvement in the treatment of cellulosic textile materials by a wide variety of finishing systems and techniques to impart desirable properties through the use of phosphonic acid derivatives as catalysts in said finishing treatments.

We have now found that phosphonic acid derivatives of the lower molecular structures, that is, those having less than 8 carbons, are effective catalysts in finishing treatments applied to cellulose-containing textiles from aqueous formulations with processing under a wide selection of curing conditions and techniques. The free acids of alkyl and aryl phosphonic acids and their magnesium and ammonium salts are excellent catalysts for treatments with agents to impart dimensional stability, durable press, and flame resistance to textile materials.

In summary, this invention provides a class of catalysts based on phosphonic acid derivatives, either in the free acid or a salt form, that are effective in treatments of cellulose-containing textiles with chemical agents following procedures of any one of several different finishing processes to impart desirable properties of dimensional stability, durable press, and flame resistance.

DESCRIPTION OF THE PREFERRED EMBODIMENTS

The preferred form for treatment is fabric but textile material may be in other forms such as fibers or yarns. In fabric form, composition of the fibers may be varied with a minimum of 50% as the cellulosic fiber. The cellulosic component may be either natural or man-made.

The chemical agents employed with the phosphonic acid derivatives to produce crosslinked fabrics with improved dimensional stability and durable press properties are selected from N-methylol amide compounds such as dimethylol compounds of ureas, ethyleneurea, dihydroxyethyleneurea, urons, triazones, pyrimidones, melamines, carbamates and the like with the preferred agent being dimethylol dihydroxyethyleneurea at concentrations ranging from about 8% to 30% by weight of the treatment bath. Formulations for producing flame resistant fabric may be selected from combinations of tetrakis(hydroxymethyl)phosphonium hydroxide (THPOH), urea, and trimethylol melamine (TMM) with a preferred molar ratio of these agents consisting of 6:5:1, respectively, at concentrations of this preferred ratio of agents ranging from about 25% to about 40% of the treatment bath.

The phosphonic acid derivatives suitable for this invention include alkyl and aryl derivatives having less than 8 carbons, their magnesium salts, and their ammonium salts. It is also within the scope of this invention to employ phosphonic acids with modified alkyl groups attached to the phosphorus atom in the acid, as for instance, a haloalkyl group, and magnesium and ammonium salts of the modified alkyl phosphonic acids. Preferred compounds of this nature are chloromethyl phosphonic acid and trichloromethyl phosphonic acid. Concentrations of catalysts may range from about 0.1 to about 30 millimoles per 100 g of treatment solution with a preferred range of 0.5 to 20 millimoles catalyst per 100 g solution.

Curing temperatures from about 100° to about 200° C are satisfactory with a preferred upper limit of 175° C at times ranging from about 1 minute to about 4 minutes, the longer times being preferred for the lower temperatures.

The following examples further describe the invention and are given as illustrations and should not be considered as limiting the scope.

Properties of the fabrics were determined by known test methods: durable press (DP) ratings after machine washing and tumble drying by AATCC Test Method 124-1968, procedure III-B; wrinkle recovery angles by AATCC Test Method 66-1968; breaking strengths by ASTM D1682-64; nitrogen by the Kjeldahl method; and phosphorus content by X-ray fluoresence as described by Tripp et al in Textile Research Journal 34, page 773–777 (1964). The match test, a widely used test by those skilled in the art for testing flame resistance, is described by Reeves and coworkers in the Textile Research Journal 23, page 257 (1957).

The increased fabric weight due to padding times 100, divided by the initial sample weight, is the percent wet pickup; the increased fabric weight due to the treatment, times 100, divided by the initial sample weight, is percent add-on; and efficiency of add-on, in percent, was determined by dividing the amount of nitrogen in the finished sample, times 100, by the amount of nitrogen applied in padding as determined from wet pickup of the treatment solution.

EXAMPLE 1

To 2.9 g (50 millimoles) of magnesium hydroxide, 15.3 g (100 millimoles) of 85% chloromethylphosphonic acid was added slowly, and the solution was brought to 100 ml volume with water. This stock solution contained 0.5 millimole of magnesium acid chloromethyl phosphonate,

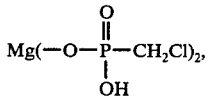

per 100 ml of solution.

To 1.45 g (25 millimoles) of magnesium hydroxide was added slowly 10.9 g (50 millimoles) of trichloromethylphosphonic acid,

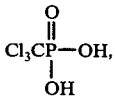

then the solution was brought to 100 ml volume with water. This stock solution contained 0.25 millimole of magnesium acid trichloromethylphosphonate,

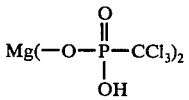

per ml of solution.

To 2.85 g (50 millimoles) of aqueous 29.8% (wt/wt) $NH_3$ was added slowly 7.68 g (50 millimoles) of 85% chloromethylphosphonic acid, then the solution was brought to 100 ml volume with water. This stock solution contained 0.5 millimole of ammonium acid chloromethylphosphonate,

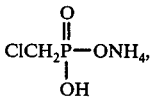

per ml of solution.

To 2.85 g (50 millimoles) of aqueous 29.8% (wt/wt) $NH_3$ was added slowly 10.9g (50 millimoles) of trichloromethylphosphonic acid, then the solution was brought to 100 ml volume with water. This stock solution contained 0.5 millimole of ammonium acid trichloromethylphosphonate,

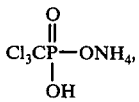

per ml of solution.

5.44 g (25 millimoles) of trichloromethylphosphonic acid were dissolved in water and diluted to 100 ml volume. This stock solution contained 0.25 millimole of trichloromethylphosphonic acid,

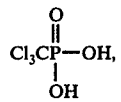

per ml of solution.

3.84 g (25 millimoles) of 85% chloromethylphosphonic acid were dissolved in water and diluted to 100 ml volume. This stock solution contained 0.25 millimole of chloromethylphosphonic acid,

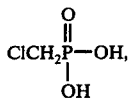

per ml of solution.

Treatment solutions were prepared such that each 100 g of solution contained 9 g of dimethylol dihydroxyethyleneurea (DMDHEU) with a catalyst. The catalyst concentrations in the treatment baths were varied by pipetting in different amounts of the stock solutions.

Cotton printcloth samples were passed into and through the treatment baths and through squeeze rolls to achieve wet pickups of about 85%. The wet, impregnated fabrics were pinned on frames, dried for 7 minutes at 60° C and cured for 3 minutes at 160° C, in a forced air-circulation oven, machine washed and tumble dried.

Table I identifies the catalyst and its concentration in millimoles (mmol) per 100 g of treatment bath and shows DP ratings after tumble drying. To those skilled in the art, it is well known that improvement in fabric dimensional stability and/or smooth drying performance may be qualitatively measured by determination of DP rating of treated fabric.

In Table I are shown the operative catalyst concentration ranges to improve dimensional stability of fabric (DP ratings of finished samples are greater than the untreated sample). To achieve satisfactory durable press performance in fabric according to those skilled in the art, a rating of 3 or higher is required. Minimum levels of catalyst concentration to achieve the desired DP level are 2 millimoles per 100 g of treatment bath for the free acids and 2.5 millimoles per 100 g of treatment bath for the magnesium salts and the ammonium acid salts of each acid derivative.

TABLE I

| Mmol/100 g treatment bath | DP Ratings of Fabric Treated with Catalysis by: | | |
|---|---|---|---|
| | free acid | magnesium acid salt | ammonium acid salt |
| | (Chloromethylphosphonic acid type catalysts) | | |
| 0.5 | 2.0 | — | — |
| 1 | 2.9 | 2.0 | 2.5 |
| 2 | 3.5 | — | — |
| 2.5 | — | 3.4 | 3.3 |
| 3 | 4.3 | — | — |
| 5 | 4.5 | 4.2 | 3.8 |
| 7.5 | — | 3.9 | 4.2 |
| 10 | — | 4.3 | 4.3 |
| 15 | — | 4.4 | 4.3 |
| | (Trichloromethylphosphonic acid type catalysts) | | |
| 0.5 | 2.5 | — | — |
| 1 | 2.9 | 2.5 | 2.4 |

TABLE I-continued

| Mmol/100 g treatment bath | DP Ratings of Fabric Treated with Catalysis by: | | |
|---|---|---|---|
| | free acid | magnesium acid salt | ammonium acid salt |
| 2 | 4.2 | — | — |
| 2.5 | — | 3.4 | 4.3 |
| 3 | 4.3 | — | — |
| 5 | 4.6 | 3.9 | 4.5 |
| 7.5 | — | 4.4 | 4.5 |
| 10 | — | — | 4.5 |
| 15 | — | — | 4.7 |
| Untreated | 1.0 | 1.0 | 1.0 |

EXAMPLE 2

A treatment solution was prepared such that each 100 g contained 9 g DMDHEU and 9 millimoles of chloromethylphosphonic acid.

Cotton printcloth samples were impregnated and dried following the procedure of Example 1. Samples were cured according to the conditions listed in Table II, then evaluated for DP after tumble drying.

TABLE II

| Curing temp. ° C | DP Rating after: | |
|---|---|---|
| | 1.5 min. cure | 3 min. cure |
| 100 | — | 2.5 |
| 120 | 2.6 | 3.2 |
| 140 | 3.3 | 3.5 |
| 160 | 3.7 | 3.7 |
| 175 | 4.6 | — |
| Untreated | 1.0 | 1.0 |

Based upon the above-mentioned generally recognized minimum acceptable DP rating of 3, it is shown in Table II that a 1.5 min. curing time at 140° C and higher is sufficient to produce a 3 rating or a 3 minute curing time is satisfactory at 120° C. The choice of curing temperatures is particularly important to finishers desiring to affect energy conservation in their textile operations. In every sample dimensional stability is increased over that of the untreated fabric. The wide range of effective curing temperatures demonstrates the versatility operative with these phosphonic acid derivatives.

EXAMPLE 3

Treatment solutions were prepared such that each 100 g of solution contained 15 g of DMDHEU with a catalyst. The catalyst concentrations in the treatment baths, shown in Table III, were prepared as in Example 1 by pipetting in stock solutions.

Cotton printcloth samples were passed into and through the treatment baths and through squeeze rolls to achieve wet pickups of about 90%. The wet, impregnated fabrics were pinned on frames then:

Mild cure processing was done by heating the samples for 2.5 minutes at 100° C, then washing and tumble drying;

Damp cure processing was done by drying fabrics for 20 minutes at 35° C to reduce moisture content to 7–12%, sealing the framed samples in plastic bags and holding for 20 hours at ambient room temperature of about 25° C, then removing the samples for washing and tumble drying.

TABLE III

| Catalyst | Mmol Catalyst per 100 g treatment bath | Mild Cure Process DP | WRA, W+F | %N | Damp Cure Process DP | WRA W+F | %N |
|---|---|---|---|---|---|---|---|
| $ClCH_2P(=O)(OH)-OH$ | 5 | 2.6 | 241 | 1.37 | 2.6 | 208 | 0.34 |
| | 10 | 3.3 | 261 | 1.74 | 2.9 | 238 | 1.22 |
| $ClCH_2P(=O)(OH)-ONH_4$ | 10 | 2.5 | 213 | 1.07 | 2.2 | 192 | 0.38 |
| $Cl_3CP(=O)(OH)-OH$ | 5 | 3.7 | 273 | 1.62 | 3.3 | 257 | 1.43 |
| | 10 | 3.6 | 279 | 1.68 | 3.5 | 270 | 1.59 |
| $Cl_3CP(=O)(OH)-ONH_4$ | 10 | 2.7 | 228 | 1.04 | 1.7 | 188 | 0.33 |
| Untreated | — | 1.3 | 190 | — | 1.3 | — | — |

Improved dimensional stability is achieved by all treatments but it is only marginal when the two ammonium salts are used in the damp cure process as seen by the DP ratings. At the 10 millimole concentration chloromethylphosphonic acid is an acceptable catalyst with DMDHEU for imparting DP properties employing the mild cure process. Trichloromethylphosphonic acid is an effective catalyst in both curing processes to develop DP ratings of 3 or higher when a concentration of at least 5 millimoles per 100 g of treatment bath is used.

This experiment further demonstrates the wide adaptability of phosphonic acid derivatives to catalysis in finishing processes.

EXAMPLE 4

To 4.8 g (25 millimoles) of phenylphosphonic acid was added 13.2 g water. To this solution was added 14.3 g (25 millimoles) of aqueous 29.8% $NH_3$. Immediately a white precipitate formed showing that the monoammonium salt of the acid (ammonium acid phenylphosphonate) was insoluble. Solubilization did not occur after standing for 8 days. To this mixture was added an additional 1.43 g (25 millimoles) of aqueous 29.8% $NH_3$ and, on shaking, complete dissolution occurred indicating that the diammonium salt was soluble. Water was added to obtain a volume of 50 ml. This stock solution contained 0.5 millimole of diammonium phenylphosphonate, $$C_6H_5-P(=O)-(ONH_4)_2$$

per ml of solution.

Treatment solutions were prepared such that each 100 g contained 9 g of DMDHEU with a catalyst. The catalyst concentrations in the treatment baths were prepared as in Example 1 by pipetting in stock solutions of the free acid or the diammonium salt.

Cotton printcloth samples were passed into and through the treatment baths and through squeeze rolls to achieve wet pickups of about 90%. The wet, impregnated fabrics were then pinned on frames, dried for 7 minutes at 60° C and cured for 3 minutes at 160° C. Fabric properties are shown in Table IV.

From Table IV it is seen that improved dimensional stability of fabric is achieved over a wide concentration range for the free acid and the diammonium salt. At least 2 millimoles of the free acid per 100 g of treatment solution or 2.5 millimoles of the diammonium salt are required to achieve the acceptable DP level of 3. These results demonstrate the utility of aromatic phosphonic acids and their diammonium salts. Furthermore, their effectiveness is not at the expense of greatly reduced fabric strength. For those skilled in the art, strength losses of 50% or greater may be expected on most cotton fabrics finished for improved durable press properties.

TABLE IV

| Catalyst concentration, mmol/100 g treatment bath | DP | WRA W+F | Brk. str., W. lbs. | % Str. loss |
|---|---|---|---|---|
| Phenylphosphonic acid | | | | |
| 0.5 | 1.9 | 214 | 41.2 | 12.2 |
| 1 | 2.6 | 232 | 38.5 | 17.9 |
| 2 | 3.3 | 263 | 32.6 | 30.5 |
| 3 | 3.6 | 274 | 30.5 | 35.0 |
| 5 | 3.6 | 274 | 28.0 | 40.3 |
| Diammonium salt of phenylphosphonic acid | | | | |
| 1 | 2.3 | 225 | 43.5 | 7.2 |
| 2.5 | 3.3 | 252 | 35.8 | 23.7 |
| 5 | 3.6 | 261 | 32.9 | 29.9 |
| 7.5 | 3.6 | 264 | 32.0 | 31.8 |
| 10 | 3.7 | 263 | 31.6 | 32.6 |
| 15 | 3.7 | 264 | 30.4 | 35.2 |
| Untreated | 1.0 | 190 | 46.9 | — |

EXAMPLE 5

20 ml of 1.25 M (25 millimoles) methylphosphonic acid were pipetted into a 50 ml volumetric flask containing 1.43 g of aqueous 29.8% $NH_3$ (25 millimoles) and then water was added to bring to volume. This stock solution contained 0.5 millimole of ammonium acid methylphosphonate,

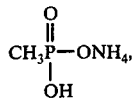

per ml of solution.

40 ml of 1.25 M (50 millimoles) methylphosphonic acid were pipetted into a 50 ml volumetric flask containing 1.45 g (25 millimoles) magnesium hydroxide and water was added to dilute to volume. This stock solution contained 0.5 millimole of magnesium acid methylphosphonate,

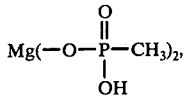

per ml of solution.

Solutions were prepared such that in each 100 g there contained:

Solution A — 9 g DMDHEU and 2.5 millimoles of methylphosphonic acid;

Solution B — 15 g DMDHEU and 10 millimoles of methylphosphonic acid;

Solution C — 9 g DMDHEU and 10 millimoles of ammonium acid methylphosphonate; and Solution D — 9 g DMDHEU and 10 millimoles of magnesium acid methylphosphonate.

Sample A, a cotton printcloth, was passed into and through Solution A then squeeze rolls to achieve a wet pickup of about 90%. The wet, impregnated fabric was pinned on a frame, dried 7 minutes at 60° C and cured 3 minutes at 160° C.

Samples B-1 and B-2, cotton printcloth, were passed into and through Solution B then squeeze rolls to achieve wet pickups of about 90%. The wet, impregnated samples were then pinned on frames. Sample B-1 was treated by the mild cure finishing process as in Example 3 and Sample B-2 was treated by the damp cure process as in Example 3.

Sample C, cotton printcloth, was passed into and through Solution C then squeeze rolls to achieve a wet pickup of about 90%. The wet, impregnated sample was pinned on a frame then treated as was Sample A.

Sample D, cotton printcloth, was passed into and through Solution D and processed as was Sample C.

All treated fabrics were then evaluated. Properties of samples are shown in Table V.

TABLE V

| Sample | %N | DP | WRA W+F |
|---|---|---|---|
| A | 1.08 | 4.3 | 277 |
| B-1 | 1.77 | 3.8 | 271 |
| B-2 | 1.28 | 3.3 | 249 |
| C | 1.05 | 3.7 | 279 |
| D | 1.01 | 4.0 | 287 |

Methylphosphonic acid is an effective catalyst for imparting durable press properties to textiles by pad-dry-cure (Sample A), mild cure (Sample B-1), and damp cure (Sample B-2) processes. All DP ratings were above 3 and wrinkle recovery was greatly increased. The extent of reaction, as measured by nitrogen content in the finished samples, is high.

The ammonium acid salt (Sample C) and the magnesium acid salt (Sample D) were excellent catalysts as shown in the above results. It is of particular interest to note that the ammonium acid salt of the alkyl phosphonate is an effective catalyst whereas the corresponding ammonium acid aryl phosphonate of Example 4 was an insoluble salt and thus not a useful catalyst for textile finishing from aqueous baths.

EXAMPLE 6

The magnesium salt of methylphosphonic acid,

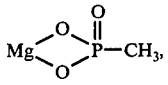

was prepared by adding 1.45 g (25 millimoles) magnesium hydroxide to 20 ml of 1.25 M (25 millimoles) methylphosphonic acid and then diluting the solution to 50 ml with water. This stock solution contained 0.5 millimole of the magnesium salt per ml.

A treatment solution was prepared such that 100 g of solution contained 9 g DMDHEU and 10 millimoles of the magnesium salt.

Sample E, a cotton printcloth and Sample F, a 50 polyester/50 cotton sheeting were processed in the treatment solution following the procedure of Example 1.

DP ratings were 4.0 for Sample E and 4.3 for Sample F; nitrogen contents of the finished fabrics were 1.08% for Sample E and 1.02% for Sample F. The example demonstrates high reactivity as seen in nitrogen contents with resultant high DP performances as seen in the DP ratings. The catalyst is effective in the treatment of fabric containing as little as 50% cotton.

EXAMPLE 7

An aqueous treatment solution was prepared such that each 100 g of solution contained 0.5 g emulsified polyethylene, 0.1 g wetting agent, 10 millimoles of catalyst, and 36 g of a mixture comprising the molar ratio of 6:5:1 of tetrakis(hydroxymethyl)phosphonium hydroxide (THPOH) to urea to trimethylol melamine (TMM), respectively.

Cotton twill fabrics of approximately 8 oz per sq. yd. were passed into and through the treatment solutions and squeeze rolls twice to achieve wet pickups of about 105%. The wet, impregnated fabrics were dried for 3 minutes at 85° C, cured for 3 minutes at 160° C, passed into and through a 2% aqueous $H_2O_2$ solution, through squeeze rolls, rinsed in running tap water for 30 minutes, then dried for 3 minutes at 85° C.

Sample G was treated with the solution containing phosphoric acid, $H_3PO_4$, catalyst;

Sample H was treated with the solution containing chloromethylphosphonic acid,

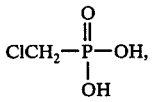

catalyst;

Sample I was treated with the solution containing phenylphosphonic acid,

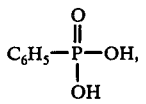

catalyst;

Sample J was treated with the solution containing magnesium acid methylphosphonate,

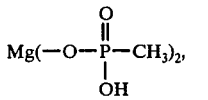

catalyst.

All samples were flame resistant in that they passed the match test at 180°.

Other results of treatments employing these catalysts are given in Table VI.

TABLE VI

| Sample | % Wet Pickup | % Add-on | % Efficiency of add-on | % P | % N | WRA W+F |
|---|---|---|---|---|---|---|
| No catalyst | 106 | 25.4 | 66.6 | 3.94 | 4.47 | 253 |
| G | 105 | 28.5 | 75.4 | 3.87 | 4.56 | 263 |
| H | 105 | 29.1 | 76.9 | 4.41 | 4.64 | 270 |
| I | 105 | 28.6 | 75.7 | 4.38 | 4.58 | 258 |
| J | 106 | 30.1 | 78.9 | 4.26 | 4.61 | 264 |

It has been demonstrated, as seen in Table VI and in the match test results, that phosphonic acid derivatives, Samples H, I, and J, are catalytically as effective in finishing fabric with a flame retardant as the mineral acid, phosphoric acid, Sample G, and, surprisingly, greater bound phosphorus contents are achieved with these phosphonic acid based catalysts than with phosphoric acid. It is well known to those skilled in the art that high phosphorus contents are important in achieving good durable textile flame resistance. The efficiency of add-ons of the treatments catalyzed by the phosphonic acid derivatives are comparable to that of phosphoric acid and does not explain the unexpected increase in phosphorus contents.

Wrinkle recovery angles, a measure of dimensional stability and smooth drying performance in fabrics, also were surprisingly high.

The example further demonstrates the wide versatility of these catalytic agents.

We claim:

1. In a process for finishing a textile material containing at least 50% cellulosic fiber to impart wrinkle resistant properties, said process of the type comprising impregnating the textile with an aqueous formulation of an N-methylol amide crosslinking agent and a catalyst, drying, and curing the impregnated textile, the improvement characterized by:

substituting as the catalyst in said formulation a monomeric phosphonic acid derivative having less than 8 carbons, selected from the group consisting of methylphosphonic acid,
chloromethylphosphonic acid,
trichloromethylphosphonic acid,
phenylphosphonic acid,
magnesium acid methylphosphonate,
magnesium methylphosphonate,
magnesium acid chloromethylphosphonate,
magnesium acid trichloromethylphosphonate,
ammonium acid methylphosphonate,
ammonium acid chloromethylphosphonate,
ammonium acid trichloromethylphosphonate, and
diammonium phenylphosphonate to provide a wide versatility in the selection of curing conditions.

2. The improved process of claim 1 wherein the phosphonic acid derivative is ammonium acid methylphosphonate.

3. The improved process of claim 1 wherein the phosphonic acid derivative is ammonium acid chloromethylphosphonate.

4. The improved process of claim 1 wherein the phosphonic acid derivative is ammonium acid trichloromethylphosphonate.

5. The improved process of claim 1 wherein the phosphonic acid derivative is diammonium phenylphosphonate.

* * * * *